US008559832B2

(12) United States Patent
Burry et al.

(10) Patent No.: US 8,559,832 B2
(45) Date of Patent: Oct. 15, 2013

(54) IMAGING APPARATUS AND METHOD OF PREDICTING THE PHOTORECEPTOR REPLACEMENT INTERVAL

(75) Inventors: Aaron Michael Burry, Ontario, NY (US); Michael F. Zona, Holley, NY (US); Eric S. Hamby, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 869 days.

(21) Appl. No.: 12/750,074

(22) Filed: Mar. 30, 2010

(65) Prior Publication Data

US 2011/0246107 A1 Oct. 6, 2011

(51) Int. Cl.
*G03G 15/00* (2006.01)

(52) U.S. Cl.
USPC ..... 399/26

(58) Field of Classification Search
USPC ..... 399/26, 31, 48, 50, 159, 170, 171; 702/64
See application file for complete search history.

(56) References Cited

U.S. PATENT DOCUMENTS

| | | | | | |
|---|---|---|---|---|---|
| 5,160,967 | A * | 11/1992 | Tonegawa | ..... | 399/26 |
| 5,359,393 | A * | 10/1994 | Folkins | ..... | 399/50 |
| 7,983,575 | B1 * | 7/2011 | Zona et al. | ..... | 399/26 |
| 2006/0165424 | A1 * | 7/2006 | Tabb et al. | ..... | 399/48 |

FOREIGN PATENT DOCUMENTS

| | | | |
|---|---|---|---|
| JP | 61080176 | A * | 4/1986 |
| JP | 2000089624 | A * | 3/2000 |

OTHER PUBLICATIONS

U.S. Appl. No. 12/647,908, filed Dec. 28, 2009 in the name of Michael F. Zona et al.

* cited by examiner

*Primary Examiner* — Robert Beatty
(74) *Attorney, Agent, or Firm* — Oliff & Berridge, PLC

(57) ABSTRACT

A system and method by which, in photoreceptor devices that use non-contact charging, an impending failure of a photoreceptor can be accurately estimated based on a determined thickness of a charge transport layer in the photoreceptor. The systems and methods may include measuring current delivered to the photoreceptor charge transport layer, measuring voltage of the photoreceptor transport layer, determining a slope of the charge device, determining the thickness of the charge transport layer based on at least one of the measured current value, voltage value, or charge device slope, and determining a photoreceptor replacement interval based on the determined thickness.

20 Claims, 8 Drawing Sheets

IMAGING APPARATUS AND METHOD OF PREDICTING THE PHOTORECEPTOR REPLACEMENT INTERVAL

BACKGROUND

This application is directed to an image forming apparatus, a system and method of predicting a photoreceptor replacement interval.

Devices such as printers, copiers, and fax machines often use a photoreceptor (also known as a photoconductor) having a photoreceptor charge transport layer. One type of photoreceptor is known as a photoreceptor drum (also know as a photoconductor drum). As the photoreceptor drum is used, the thickness of the photoreceptor charge transport layer is reduced. There comes a time when, at a certain thickness point, the photoreceptor charge transport layer becomes thin enough that it will no longer support latent image production and, therefore, the charge transport layer of the photoreceptor is considered to have failed. In view of this, manufacturers of photoreceptor devices generally provide users with a fixed interval setting to replace the photoreceptor in the device. This fixed interval setting is set by the manufacturer for an entire population of a particular type of photoreceptor. This fixed interval setting is intended to ensure that the photoreceptor is replaced prior to the charge transport layer becoming reduced enough so as not to support image reproduction. A difficulty is that this fixed interval setting does not take into consideration the manner or environment in which a user actually uses the device having the photoreceptor. Replacing the photoreceptor at a fixed interval typically results in more frequent replacement of the photoreceptor than what is required for individual use of a device.

Instead of replacing the photoreceptor at a fixed interval, it has been considered that in-situ determination of the photoreceptor charge transport layer thickness could be made and used to predict failure of a photoreceptor. Predicting failure of the photoreceptor charge transport layer on an individual basis eliminates the need for replacing the photoreceptor at a predetermined interval, for example, while a particular photoreceptor still has a remaining useful life based on the thickness of the photoreceptor charge transport layer. Performing a predictive calculation based on the use of an individual photoreceptor enables a user to reduce the cost of operating a device having the photoreceptor by running each photoreceptor to a point at which the photoreceptor charge transport layer is just about to fail.

Some effort has been expended to enable in-situ determination of photoreceptor charge transport layer thickness for devices that use bias charged roll chargers. This effort is based on key characteristic behaviors of bias charged roll chargers, and in particular, the saturation of the photoreceptor voltage at the characteristic "knee" of the charge curve.

Many marking engines use non-contact charging of the photoreceptor. One type of non-contact charging is scorotron charging, which uses corona discharge to generate ions that are directed to a surface of the photoreceptor charge transport layer. A scorotron usually includes coronode wires with a scorotron grid formed by a metal mesh or screen placed between the coronode wires and the surface of the photoreceptor charge transport layer. The scorotron grid is biased to a potential close to that desired at the surface of the photoreceptor charge transport layer. When the surface potential of the photoreceptor charge transport layer reaches the potential of the scorotron grid bias, the photoreceptor charging process ceases.

The key characteristic behaviors of bias charged roll chargers are completely inapplicable for photoreceptor devices that use non-contact charging.

A method of predicting the photoreceptor replacement interval in photoreceptor devices that use a scorotron charge device is disclosed in U.S. patent application Ser. No. 12/647,908. However, that disclosed method makes several assumptions regarding variables that affect the photoreceptor thickness estimation. For example, in U.S. patent application Ser. No. 12/647,908, an initial voltage of the photoreceptor charge transport layer and a slope of the scorotron charge device are assumed to be known constants.

SUMMARY

It would be advantageous in view of the above discussion to provide systems and methods to accurately estimate impending failure of a photoreceptor based on a determined thickness of a charge transport layer in a photoreceptor device that uses non-contact charging under all conditions, without making any assumptions or applying any constants.

The present disclosure exemplarily describes a photoreceptor that has a photoreceptor charge transport layer that is charged using a non-contact charging device, and an imaging apparatus and method of predicting the photoreceptor replacement interval, based on a determined thickness of a charge transport layer in the photoreceptor.

In exemplary embodiments, there is provided a method that may predict a photoreceptor replacement interval. The method may include measuring a charging current of a charging device, measuring a grid current from at least one of grid wires and a shield, measuring a voltage of a photoreceptor charge transport layer of a photoreceptor. The method may then compute a thickness of the photoreceptor charge transport layer based on the measured charging current, the measured grid current, and the measured voltage of the photoreceptor charge transport layer to determine a replacement interval based on the computed thickness of the photoreceptor charge transport layer. Information regarding a computed thickness of the photoreceptor charge transport layer and a determined replacement interval based on the computed thickness may be at least one of stored in, or output from, the device for reference by a user or otherwise, for example, by maintenance personnel.

In exemplary embodiments, a scorotron charge device may be used as the charging device. The scorotron charge device may typically include coronode wires, a scorotron shield, and a scorotron grid positioned between the coronode wires and the photoreceptor charge transport layer.

In exemplary embodiments, the method may include measuring an initial voltage ($V_{initial}$) of the photoreceptor charge transport layer after a pre-charge erase of the photoreceptor charge transport layer.

In exemplary embodiments, the method may include measuring an intercept voltage ($V_{intercept}$) of the photoreceptor charge transport layer after rotating the photoreceptor to consecutively charge the photoreceptor charge transport layer by the charge device with a pre-charge erase device being off, so that charge continues to build through each revolution of the photoreceptor.

In exemplary embodiments, the method may include determining a slope (S) of the scorotron charge device between a first data point and a second data point.

In exemplary embodiments, the thickness of the photoreceptor charge transport layer may be computed based on at least one of $V_{initial}$, $V_{intercept}$, and the slope (S).

In exemplary embodiments, the method may include measuring the voltage using at least one of (1) a pre-development electrostatic voltmeter positioned between an exposure device and a development device and (2) a pre-charge electrostatic voltmeter positioned between a pre-charge erase device and the scorotron charge device.

In exemplary embodiments, the method may include determining the thickness of the photoreceptor charge transport layer during either a test mode or between printing of subsequent customer images of a single job, where a circumference of the photoreceptor charge transport layer is greater than a length of the customer image. The determination may be made with respect to a portion of the photoreceptor charge transport layer not contacting the customer image in operation.

In exemplary embodiments, the method may include storing a previously determined thickness of the photoreceptor charge transport layer; and determining the replacement interval based on the computed thickness of the photoreceptor charge transport layer and the previously-stored thickness of the photoreceptor charge transport layer.

In exemplary embodiments, there may be provided a system for predicting a photoreceptor replacement interval. The system may include a first current measuring device that measures charge current supplied to coronode wires and outputs a first current value, and a second current measuring device that measures grid current delivered to at least one of grid wires and a shield and outputs a second current value. The system may further include a voltage measuring device that measures voltage of the photoreceptor charge transport layer and outputs a photoreceptor charge transport layer voltage value and a processor that receives the current values and the voltage value, and determines a photoreceptor replacement interval based on a thickness of the photoreceptor charge transport layer. In such a system, the determined thickness of the photoreceptor charge transport layer may be based on one or more of the first current value, the second current value, and the photoreceptor charge transport layer voltage value. The system may also include a storage device for storing the photoreceptor replacement interval and/or a display device for displaying the photoreceptor replacement interval. The system may include a scorotron charge device including coronode wires, a scorotron shield, and a scorotron grid positioned between the coronode wires and the photoreceptor charge transport layer.

In exemplary embodiments, the system may include a pre-charge erase device and a controller that controls the voltage measuring device, the first current measuring device, and the second current measuring device. The controller may be configured to measure an initial voltage $V_{initial}$, an intercept voltage $V_{intercept}$, and data corresponding to a first data point and a second data point. The processor may be configured to receive the first data point measurement and the second data point measurement, and to calculate a slope (S) of the scorotron charge device and determine the thickness of the photoreceptor charge transport layer based on the slope (S) and at least one of $V_{initial}$ and $V_{intercept}$. The controller may also be configured to determine a dynamic current ($I_{dynamic}$) delivered to the photoreceptor charge transport layer as the difference between a first current value and a second current value.

In exemplary embodiments, the system may include (1) a pre-charge electrostatic voltmeter positioned between the pre-charge erase device and the scorotron charge device and/or (2) a pre-development electrostatic voltmeter positioned between an exposure device and a development device.

In exemplary embodiments, there may be provided an image forming device including the system for predicting a photoreceptor replacement interval described above. The image forming device may include a xerographic image forming device.

These and other features and advantages of the disclosed systems and methods are described in, or apparent from, the following detailed description of various exemplary embodiments.

BRIEF DESCRIPTION OF THE DRAWINGS

Various exemplary embodiments are described, in detail, with reference to the following figures, wherein elements having the same reference numeral designations represent like elements throughout, and in which.

DETAILED DESCRIPTION OF EMBODIMENTS

The following embodiments illustrate examples of systems and methods for determining a replacement interval for a photoreceptor in a photoreceptor imaging system. The following description of various exemplary embodiments may refer to one specific type of image forming device, such as, for example, an electrostatic or xerographic image forming device, and discuss various terms related to image production within such an image forming device, for the sake of clarity, and ease of depiction and description. It should be appreciated, however, that, although the systems and methods according to this disclosure may be particularly adapted to such a specific application, the depictions and/or descriptions included in this disclosure are not intended to be limited to any specific application.

In referring to, for example, image forming devices as this term is to be interpreted in this disclosure, such devices may include, but are not limited to, copiers, printers, scanners, facsimile machines and/or xerographic image forming devices.

Figure 1:
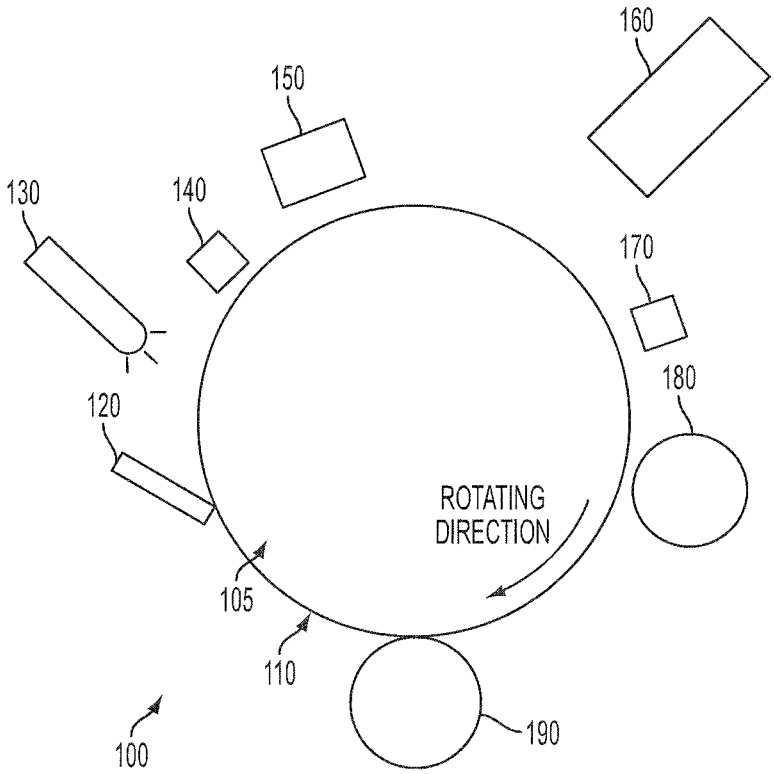
FIG. 1 is a schematic illustration of an exemplary xerographic station of a xerographic image forming device with which the systems and methods according to this disclosure may be used.

Referring to FIG. 1, there is shown a schematic view of an exemplary xerographic station 100 of an image forming device. Although the disclosure includes reference to the exemplary embodiments shown in the drawings, it should be understood that many alternate forms or embodiments exist. In addition, any suitable size, shape or type of elements or materials could be used.

As shown in FIG. 1, the exemplary xerographic station 100 may generally include a photoreceptor 105 with a photoreceptor charge transport layer 110 on a radially outer part of the photoreceptor 105, a blade cleaner 120, a pre-charge erase device 130, a pre-charge electrostatic voltmeter 140, a scorotron charge device 150, an exposure device 160, a pre-development electrostatic voltmeter 170, a development device 180, and a bias transfer roll 190.

During operation, the pre-charge erase device 130 may remove most of the charge remaining on the photoreceptor charge transport layer 110. However, the pre-charge erase device 130 does not necessarily remove all the remaining charge on the photoreceptor charge transport layer 110. Thus, the photoreceptor charge transport layer 110 may retain some charge after passing through the pre-charge erase device 130, even when the pre-charge erase device 130 is operating.

The pre-charge electrostatic voltmeter 140 may measure the voltage of the photoreceptor charge transport layer 110 after passing through the pre-charge erase device 130, but before passing through the scorotron charge device 150. It should be noted that, while in the exemplary embodiments an electrostatic voltmeter is used, other known methods of measuring voltage may be used.

The scorotron charge device 150 may operate to charge the photoreceptor charge transport layer 110. The scorotron charge device 150 will be described in greater detail with reference to FIG. 2.

A pre-development electrostatic voltmeter 170 may measure the voltage of the photoreceptor charge transport layer 110 before passing through the development device 180. The bias transfer roll 190 may optionally perform voltage measurements of the photoreceptor charge transport layer 110.

Figure 2:
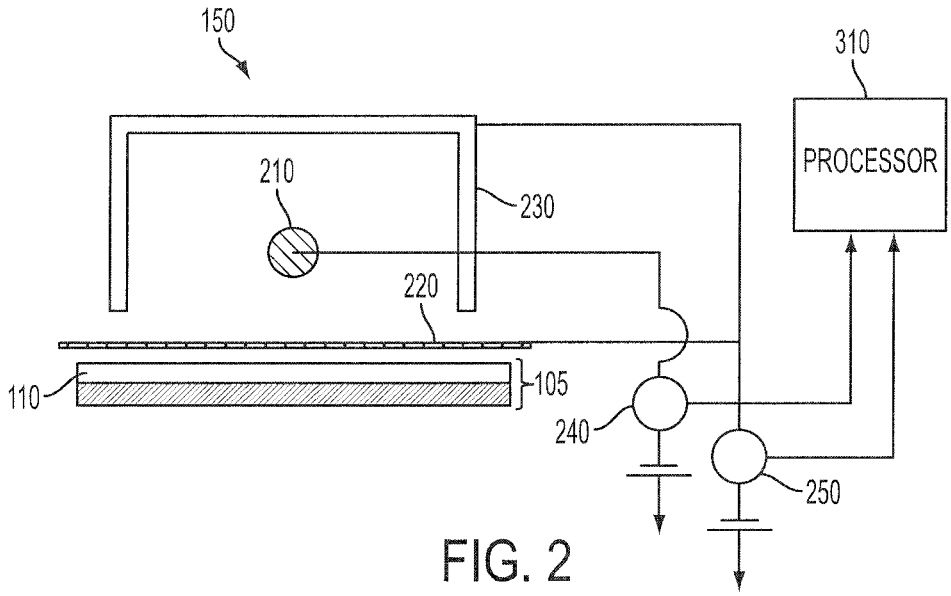
FIG. 2 is a schematic illustration of an exemplary scorotron charge device which may be used in the system of FIG. 1.

Referring to FIG. 2, an exemplary scorotron charge device 150 is shown. The exemplary scorotron device 150 may use corona discharge to generate ions that are directed to the surface of the photoreceptor charge transport layer 110. The exemplary scorotron charge device 150 may include coronode wires 210, a scorotron grid 220 and a scorotron shield 230 covering the coronode wires 210. The scorotron grid 220 may be positioned between the coronode wires 210 and the surface of the photoreceptor charge transport layer 110 so as to face an open surface of the scorotron shield 230. The scorotron grid wires 220 may include a plurality of wires having a diameter larger than a diameter of the coronode wires 210 or a screened metal mesh. In the exemplary scorotron charge device 150, the scorotron shield 230 is an electrically conducting box member, and a surface thereof facing the photoreceptor charge transport layer 110 is open.

To charge the photoreceptor charge transport layer 110, bias voltages may be applied to the scorotron grid 220, the coronode wires 210 and the scorotron shield 230. The bias voltage applied to the scorotron grid 220 may be a potential close to that desired at the surface of the photoreceptor charge transport layer 110 and may be different from a bias voltage applied to the coronode wires 210. In exemplary embodiments, the bias voltage applied to the scorotron grid 220 may be the same as the bias voltage applied to the scorotron shield 230. However, in other exemplary embodiments, the bias voltage applied to the scorotron grid 220 may be different from the bias voltage applied to the scorotron shield 230. When the surface potential of the photoreceptor charge transport layer 110 reaches substantially the potential of the scorotron grid bias, the photoreceptor charging process essentially ceases.

As shown in FIG. 2, a first current measuring device 240 may measure charge current supplied to the coronode wires 210 and may output a first current value to a processor 310. A second current measuring device 250 may measure grid current delivered to grid wires 220 and a shield 230 and may output a second current value to the processor 310. The processor 310 may then compute a dynamic current ($I_{dynamic}$) that is the difference between the current value measured by the first current measuring device 240 and the current value measured by the second current measuring device 250.

Figure 3:
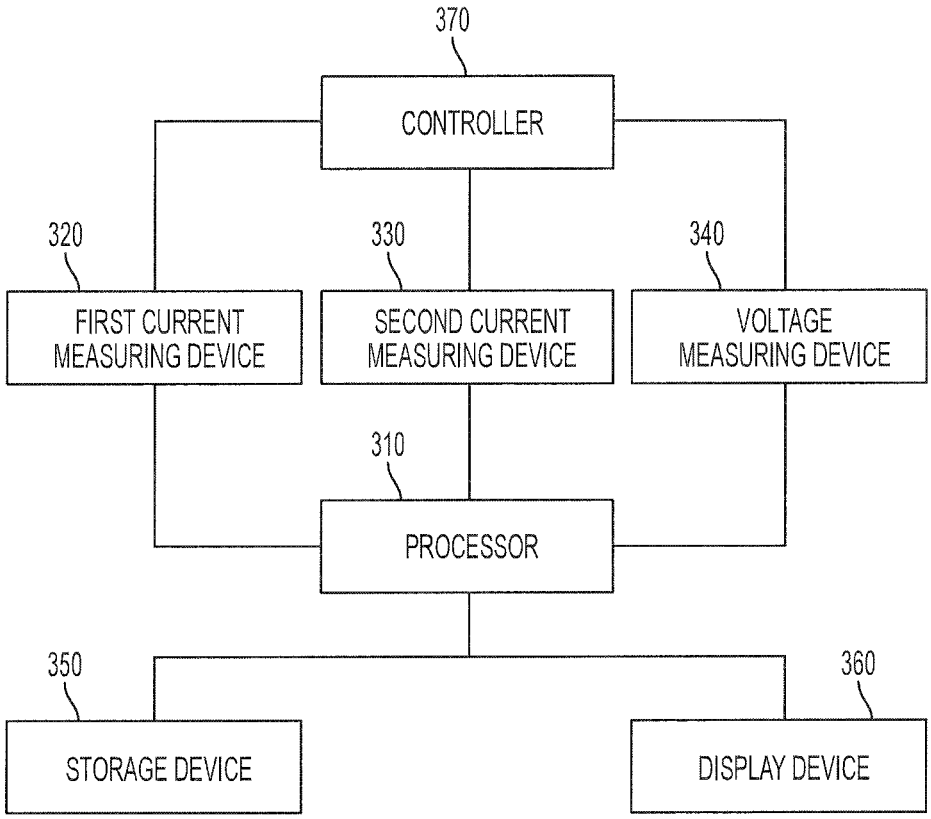
FIG. 3 is a schematic illustration of an exemplary system for predicting a photoreceptor replacement interval according to this disclosure.

Referring now to FIG. 3, there is shown a schematic view of an exemplary system for predicting a photoreceptor replacement interval. A controller 370 may control a first current measuring device 320 to measure charge current supplied, for example, to coronode wires. The controller 370 may also control a second current measuring device 330 to measure, for example, a grid current delivered to at least one of grid wires and a shield. The controller 370 may also control a voltage measuring device 340 to measure a voltage of the photoreceptor charge transport layer 110. The first current measuring device 320, the second current measuring device 330, and the voltage measuring device 340 may each output respective current and voltage measurement values to the processor 310. The processor 310 may, in turn, determine a photoreceptor replacement interval based on a thickness of the photoreceptor charge transport layer 110. The thickness of the photoreceptor charge transport layer 110 may be computed by the processor 310 based on the current and voltage measurement values. The processor 310 then may store the calculated photoreceptor replacement interval in a storage device 350, and/or may display the photoreceptor replacement interval on a display device 360. Any storage and display of the photoreceptor replacement interval may take place concurrently, or at separate times. While FIG. 3 shows a controller 370 separate from a processor 310, the controller 370 and processor 310 may optionally be combined as a single device.

Figure 4:
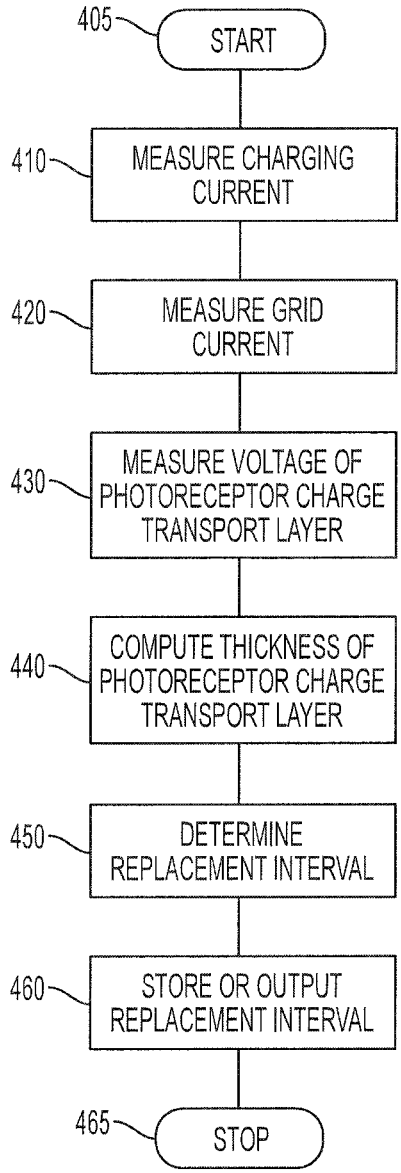
FIG. 4 illustrates a flow diagram of an exemplary method of determining a photoreceptor replacement interval according to this disclosure.

Referring now to FIG. 4, there is shown a flow diagram of an exemplary method of determining the photoreceptor replacement interval. Operation of the method commences at step 405 upon the occurrence of an event. The event may be user initiated, based on a predetermined schedule, in response to a system irregularity, or any other number of events. Regardless of how the sequence commences, operation of the method proceeds to step 410.

In step 410, a charging current may be measured by a current measuring device. Operation of the method proceeds to step 420.

In step 420, a grid current may be measured using a current measuring device. The current measuring devices used in steps 410 and 420 may be different current measuring devices. Operation of the method proceeds to step 430.

In step 430, a voltage of the photoreceptor charge transport layer may be measured using a voltage measuring device. Operation of the method proceeds to step 440.

In step 440, a thickness of the photoreceptor charge transport layer may be computed based on the measured charging current value in step 410, the measured grid current value in step 420, and the measured voltage value of the photoreceptor charge transport layer in step 430. Operation of the method proceeds to step 450.

In step 450, a replacement interval may be determined based on the computed thickness of the photoreceptor charge transport layer in step 440. Operation of the method proceeds to step 460.

In step 460, the replacement interval determined in step 450 may be stored and/or output. It should be noted that the current measuring and voltage measuring steps may be carried out using known voltage and current measuring devices. It should be noted that at least steps 410, 420 and 430 do not necessarily have to be carried out in the above described order and may be carried out sequentially, serially, or simultaneously. Operation of the method proceeds to step 465 where operation of the method ceases.

Figure 5:
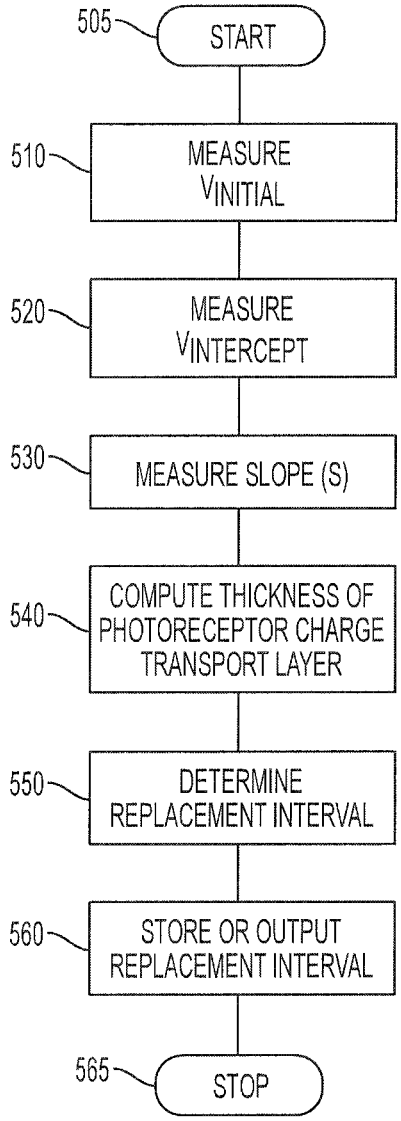
FIG. 5 illustrates a flow diagram of a second exemplary method of determining a photoreceptor replacement interval according to this disclosure.

Referring now to FIG. 5, there is shown a flow diagram of a second exemplary method of determining the photoreceptor replacement interval. Operation of the method commences at step 505 upon the occurrence of an event. The event may be user initiated, based on a predetermined schedule, in response to a system irregularity, or any other number of events. Regardless of how the sequence commences, operation of the method proceeds to step 510.

In step 510, an initial voltage $V_{initial}$ of the photoreceptor charge transport layer 110 may be measured. Measurement of $V_{initial}$ will be described in greater detail with reference to FIG. 6. Operation of the method proceeds to step 520.

In step 520, an intercept voltage $V_{intercept}$ of the photoreceptor charge transport layer may be measured. The measurement of $V_{intercept}$ will be described in greater detail with reference to FIG. 6. Operation of the method proceeds to step 530.

In step 530, a slope (S) of the scorotron charge device 150 may be measured. The measurement of the slope (5) of the scorotron charge device 150 will be described in greater detail with reference to FIG. 7. Operation of the method proceeds to step 540.

In step 540, the thickness of the photoreceptor charge transport layer may be computed based on the measured $V_{initial}$ in step 510, the measured $V_{intercept}$ in step 520, and the measured slope (5) in step 530. It should be noted that steps 510, 520, and 530 do not necessarily have to be carried out in that order and may be carried out sequentially, serially, or simultaneously. Operation of the method proceeds to step 550.

In step 550, a replacement interval may be determined based on the computed thickness of the photoreceptor charge transport layer in step 540. Determination of a replacement interval will be described in greater detail with reference to FIG. 8. Operation of the method proceeds to step 560.

In step 560, the replacement interval determined in step 550 may be stored or output. Operation of the method proceeds to step 565 where operation of the method ceases.

Figure 6:
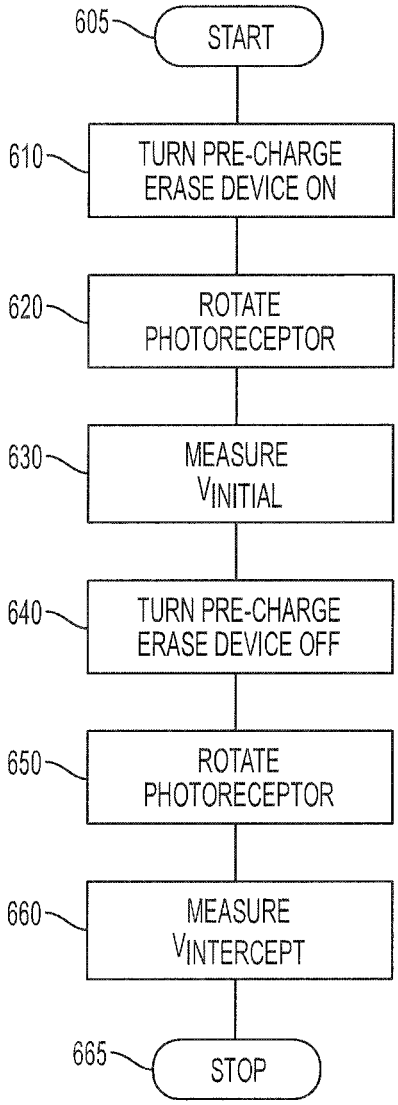
FIG. 6 illustrates a flow diagram of an exemplary method of measuring $V_{initial}$ and $V_{intercept}$ according to this disclosure.

Referring now to FIG. 6, there is shown a flow diagram of an exemplary method of measuring $V_{initial}$ and $V_{intercept}$. Operation of the method commences at step 605 upon occurrence of an event, for example, entry of the method illustrated in FIG. 5 into step 510 or 520. Regardless of how the sequence commences, operation of the method proceeds to step 610.

In step 610, a pre-charge erase device 130 may be energized. Operation of the method proceeds to step 620.

In step 620, a photoreceptor 105 may be rotated so that, as the photoreceptor charge transport layer 110 passes the pre-charge erase device 130, residual charge on the photoreceptor charge transport layer 110 may be substantially removed. However, in many instances, a small residual voltage may remain on the photoreceptor charge transport layer 110 even after passing through the pre-charge erase device 130. Operation of the method proceeds to step 630.

In step 630, the initial voltage $V_{initial}$ of the photoreceptor charge transport layer 110, after passing the pre-charge erase device 130 when the pre-charge erase device 130 is energized, may be measured. The measurement of $V_{initial}$ in step 630 may be carried out by a pre-charge electrostatic voltmeter 140, a pre-development electrostatic voltmeter 170, by the bias transfer roll 190, or by other known means. If the measurement of $V_{initial}$ in step 630 is carried out by a device other than a pre-charge electrostatic voltmeter 140, the scorotron charge device 150, and other devices such as an exposure device 160 or a development device 180 that may affect the photoreceptor charge transport layer voltage, may be turned off in a case where the photoreceptor charge transport layer 110 passes through such a device after passing through the pre-charge erase device 130 and before the measurement of $V_{initial}$. Operation of the method proceeds to step 640.

In step 640, the pre-charge erase device 130 may be turned off. Operation of the method proceeds to step 650.

In step 650, the photoreceptor 105 rotates, or continues to rotate, so that charge may continue to build through each revolution of the photoreceptor 105. While a single revolution may be sufficient to measure $V_{intercept}$, rotating the photoreceptor 105 through multiple complete revolutions may allow a more accurate measurement of $V_{intercept}$. While rotating the photoreceptor 105 with the pre-charge erase device 130 off, other devices which may affect the voltage of the photoreceptor charge transport layer 110 may also be turned off, with the exception of the scorotron charge device 150, which may continue to charge the photoreceptor charge transport layer 110. Operation of the method proceeds to step 660.

In step 660, an intercept voltage of the photoreceptor charge transport layer 110, which may be a voltage of the photoreceptor charge transport layer 110 when substantially no additional current is delivered to the photoreceptor charge transport layer 110 during charging by the scorotron charge device 150, may be measured. The measurement of $V_{intercept}$ may be carried out by the pre-charge electrostatic voltmeter 140, the pre-development electrostatic voltmeter 170, the bias transfer roll 190, or other known voltage measuring methods. While the method of measuring $V_{initial}$ and $V_{intercept}$ has been described in a particular order, the measurement of $V_{initial}$ and $V_{intercept}$ could be performed non-sequentially, or in another order. Operation of the method proceeds to step 665 where operation of the method ceases.

Figure 7:
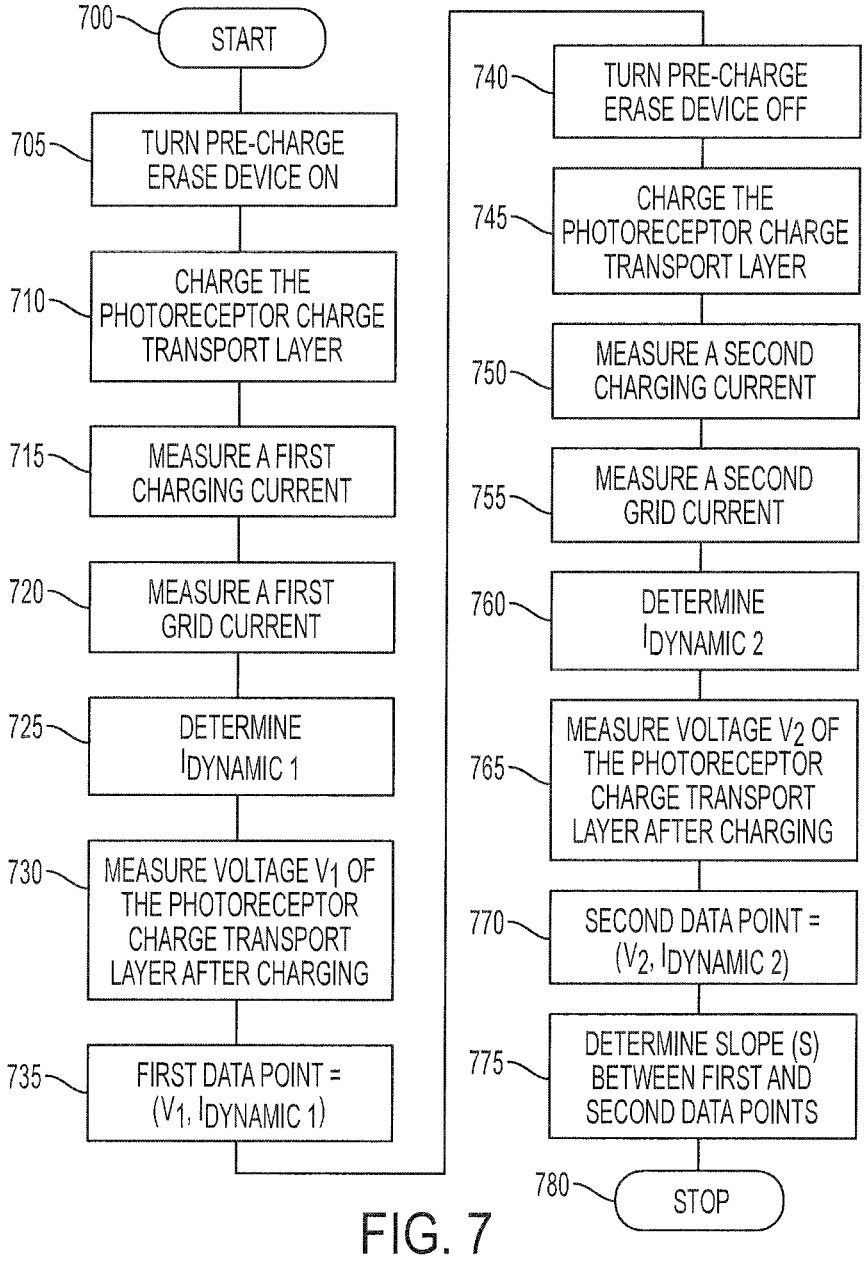
FIG. 7 illustrates a flow diagram of an exemplary method of measuring the slope (S) of a charge device for use in the determinations according to this disclosure.

Referring to FIG. 7, there is shown a flow diagram of an exemplary method of measuring the slope (S) of the charge device. Operation of the method commences at step 700 upon the occurrence of an event, for example, entry of the method illustrated in FIG. 5 into step 530. Regardless of how the sequence commences, operation of the method proceeds to step 705.

In step 705, a pre-charge erase device 130 may be energized. Operation of the method proceeds to step 710.

In step 710, the photoreceptor 105 may be rotated and the photoreceptor charge transport layer 110 may be charged by a scorotron charge device 150. Operation of the method proceeds to step 715.

In step 715, a first charging current may be measured, such as by a first current measuring device 240, during charging of the photoreceptor charge transport layer 110. Operation of the method proceeds to step 715.

In step 720, a first grid current may be measured, such as by a second current measuring device 250, during charging of the photoreceptor charge transport layer 110. Step 720 may be performed concurrently with step 715. Operation of the method proceeds to step 725.

In step 725, a first dynamic current $I_{dynamic\ 1}$ may be determined, such as by processor 310, as the difference between the first charging current value and the first grid current value. Operation of the method proceeds to step 730.

In step 730, a voltage V1 of the photoreceptor charge transport layer 110 may be measured after charging the photoreceptor charge transport layer 110. The measurement of V1 may be carried out by a pre-development electrostatic voltmeter such as 170. Operation of the method proceeds to step 735, where the first data point is set as (V1, $I_{dynamic\ 1}$). Operation of the method proceeds to step 740.

In step 740, with the photoreceptor 105 continuing to rotate, the pre-charge erase device 130 may be turned off. Operation of the method proceeds to step 745.

In step 745, the photoreceptor charge transport layer 110 may again be charged by the scorotron charge device 150 after the photoreceptor charge transport layer 110 has rotated through the pre-charge erase device 130 with the pre-charge erase device 130 being off. Operation of the method proceeds to step 750.

In step 750, a second charging current may be measured during the charging of the photoreceptor charge transport layer 110 of step 745. Operation of the method proceeds to step 755.

In step 755, a second grid current may be measured during the charging of the photoreceptor charge transport layer 110 of step 745. Operation of the method proceeds to step 760.

In step 760, processor 310 may determine a second dynamic current $I_{dynamic\ 2}$ that is the difference between the second charging current value and the second grid current value measured in steps 750 and 755. Operation of the method proceeds to step 765.

In step 765, a voltage V2 of the photoreceptor charge transport layer 110 may be measured after the charging of step 745. The measurement of voltage V2 may be carried out by a pre-development electrostatic voltmeter 170, to minimize errors introduced by such factors as dark decay as the photoreceptor rotates in time. However, the pre-charge electrostatic voltmeter 140, or the bias transfer roll 190, may also be used in step 765. Operation of the method proceeds to step 770, where the second data point is set as (V2, $I_{dynamic\ 2}$). Operation of the method proceeds to step 775.

In step 775, the processor 310 may determine the slope (S) of the scorotron charge device 150 as the slope between the first and the second data points. While the method of measuring the slope (S) of the charge device has been described as being carried out consecutively, the first data point and the second data point could be measured non-sequentially. Operation of the method proceeds to step 780 where operation of the method ceases.

Figure 8:
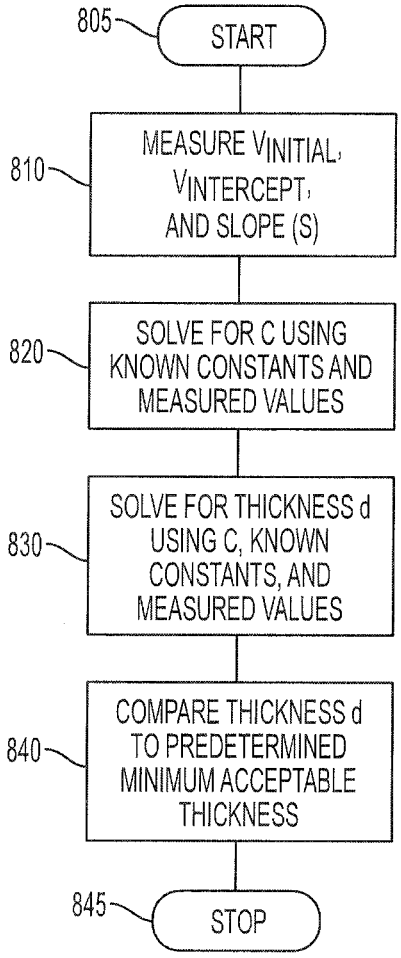
FIG. 8 illustrates a flow diagram of an exemplary method of computing a thickness of a photoreceptor charge transport layer and determining a replacement interval according to this disclosure.

Referring now to FIG. 8, there is shown a flow diagram of an exemplary method of determining the thickness of the photoreceptor charge transport layer 110 and a replacement interval. Operation of the method commences at step 805 upon the occurrence of an event, for example, entry of the method illustrated in FIG. 5 into step 540. Regardless of how the sequence commences, operation of the method proceeds to step 810.

In step 810, an initial voltage $V_{initial}$ of the photoreceptor charge transport layer, an intercept voltage $V_{intercept}$, and a slope (S) of the charge device may be measured. The measurements may be carried out, for example, as discussed above. Operation of the method proceeds to step 820.

Using the measured $V_{initial}$, $V_{intercept}$, and slope (S), in steps 820 and 830, the processor 310 may determine the thickness of the photoreceptor charge transport layer 110 by solving the equations:

$$I_{dynamic\ 1}=Cv(V_{intercept}-V_{initial})(1-e^{-S/Cv}) \quad (1)$$

$$C=\in_0 k/d\times 10^6 \quad (2)$$

where d=the thickness of the photoreceptor charge transport layer that is to be determined, k=the dielectric constant of the photoreceptor charge transport layer (a known constant), $\in_0$=permittivity of free space (a constant equal to $8.85\times 10^{-12}$), C=capacitance per unit area of the photoreceptor charge transport layer in μf/meter$^2$ (to be solved in equation (1)), and v=velocity of the surface of the photoreceptor charge transport layer in meters/second (a known constant).

In step 820, the processor 310 may use equation (1), including the measured $V_{initial}$, $V_{intercept}$, and slope (S), to determine the capacitance C of the photoreceptor charge transport layer. Operation of the method proceeds to step 830.

In step 830, the processor 310 may use equation (2), including the determined capacitance C in step 830, to determine the thickness d of the photoreceptor charge transport layer. Operation of the method proceeds to step 840.

In step 840, the processor 310 may compare the calculated thickness d to a predetermined thickness representing a minimum acceptable thickness of the photoreceptor charge transport layer. If the measured thickness d is smaller than the predetermined minimum acceptable thickness, the processor 310 may output a replacement warning to the storage and/or display device.

The processor 310 may additionally use historical measured and stored thicknesses of the photoreceptor charge transport layer to predict a photoreceptor replacement interval, and store and/or output the predicted photoreceptor replacement interval. For example, the processor 310 may perform regression or extrapolation with the stored historical thickness values to predict the photoreceptor replacement interval. The processor 310 is not limited to any particular mathematical operation on the stored historical thickness values in determining a predicted photoreceptor replacement interval.

The predetermined minimum acceptable thickness of the photoreceptor charge transport layer may be standard across all xerographic imaging devices of a specific type, or may be input based on user preferences, or set in another manner. While computing the thickness of the photoreceptor charge transport layer 110 and determining a replacement interval has been described with respect to measuring $V_{initial}$, $V_{intercept}$, and slope (S), equations (1) and (2) may alternatively be used with at least one of $V_{initial}$, $V_{intercept}$, and slope (S), and replacing the non-measured variables with estimated or assumed constants, rather than actual measured values. Operation of the method proceeds to step 845 where operation of the method ceases.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method of predicting a photoreceptor replacement interval, comprising:

measuring a charging current of a charging device;

measuring a grid current from at least one of grid wires and a shield;

measuring a voltage of a photoreceptor charge transport layer of a photoreceptor;

computing a thickness of the photoreceptor charge transport layer based on the measured charging current, the measured grid current, and the measured voltage of the photoreceptor charge transport layer;

determining a replacement interval based on the computed thickness of the photoreceptor charge transport layer; and at least one of storing or outputting the replacement interval.

2. The method of claim 1, wherein the charging current is a current that is supplied to coronode wires of a scorotron charge device.

3. The method of claim 2, wherein the grid current is a current from the at least one of a scorotron grid and a scorotron shield of the scorotron charge device, the scorotron grid being positioned between the coronode wires and the photoreceptor charge transport layer.

4. The method of claim 1, the measuring the voltage of the photoreceptor charge transport layer further comprising:

measuring a voltage ($V_{initial}$) of the photoreceptor charge transport layer after a pre-charge erase of the photoreceptor charge transport layer, wherein the thickness of the photoreceptor charge transport layer is computed based on the measured charging current, the measured grid current, and $V_{initial}$.

5. The method of claim 1, the measuring the voltage of the photoreceptor charge transport layer further comprising:

measuring a voltage ($V_{intercept}$) of the photoreceptor charge transport layer after rotating the photoreceptor to consecutively charge the photoreceptor charge transport layer by the charge device with a pre-charge erase device being off, so that charge continues to build through each revolution of the photoreceptor, wherein the thickness of the photoreceptor charge transport layer is computed based on the measured charging current, the measured grid current, and $V_{intercept}$.

6. The method of claim 3, further comprising:

determining a slope (S) of the scorotron charge device between a first data point and a second data point, wherein the thickness of the photoreceptor charge transport layer is computed based on the measured charging current, the measured grid current, the measured voltage of the photoreceptor charge transport layer, and the slope (S).

7. The method of claim 6, wherein determining the slope (S) further comprises:

measuring the first data point by rotating the photoreceptor with a pre-charge erase device on, the measuring including:

charging the photoreceptor charge transport layer by the scorotron charging device, measuring a first charging current, measuring a first grid current, determining a dynamic current ($I_{dynamic\ 1}$) delivered to the photoreceptor charge transport layer as the difference between the first charging current and the first grid current, and measuring a voltage ($V_1$) of the photoreceptor charge transport layer after charging the photoreceptor charge transport layer, the first data point being ($V_1$, $I_{dynamic\ 1}$);

measuring the second data point by rotating the photoreceptor with the pre-charge erase device off, the measuring including:

charging the photoreceptor charge transport layer by the scorotron charging device, the photoreceptor charge transport layer entering a scorotron charging area with a residual charge due to the pre-charge erase device being off, measuring a second charging current, measuring a second grid current, determining a dynamic current ($I_{dynamic\ 2}$) delivered to the photoreceptor charge transport layer as the difference between the second charging current and the second grid current, and measuring a voltage ($V_2$) of the photoreceptor charge transport layer after charging the photoreceptor charge transport layer, the second data point being ($V_2$, $I_{dynamic\ 2}$); and determining the slope (S) as the slope between the first data point and the second data point.

8. The method of claim 7, further comprising:

measuring a voltage ($V_{initial}$) of the photoreceptor charge transport layer after the pre-charge erase of the photoreceptor charge transport layer; and measuring a voltage ($V_{intercept}$) of the photoreceptor charge transport layer after rotating the photoreceptor to consecutively charge the photoreceptor charge transport layer by the scorotron charge device with the pre-charge erase device being off, so that charge continues to build through each revolution of the photoreceptor, wherein the thickness of the photoreceptor charge transport layer is computed based on the slope (S), $V_{initial}$, and $V_{intercept}$.

9. The method of claim 8, wherein the thickness of the photoreceptor charge transport layer is determined by solving the following equations:

$$I_{dynamic\ 1}=Cv(V_{intercept}-V_{initial})(1-e^{-S/Cv})$$

$$C=\epsilon_0 k/d\times 10^6$$

where d=the thickness of the photoreceptor charge transport layer that is to be determined, k=the dielectric constant of the photoreceptor charge transport layer (a known constant), $\epsilon_0$=permittivity of free space (a constant equal to $8.85\times 10^{-12}$), C=capacitance per unit area of the photoreceptor charge transport layer in μf/meter$^2$ (to be determined), and v=velocity of the surface of the photoreceptor charge transport layer in meters/second (a known constant).

10. The method of claim 8, wherein at least one of the voltage measurements $V_{initial}$, $V_{intercept}$, $V_1$, and $V_2$ is measured using at least one of (1) a pre-development electrostatic voltmeter positioned between an exposure device and a development device and (2) a pre-charge electrostatic voltmeter positioned between the pre-charge erase device and the scorotron charge device.

11. The method of claim 1, wherein the thickness of the photoreceptor charge transport layer is determined during a test mode.

12. The method of claim 1, wherein the thickness of the photoreceptor charge transport layer is determined between printing of subsequent customer images of a single job where a circumference of the photoreceptor charge transport layer is greater than a length of a customer image, the determination being made with respect to a portion of the photoreceptor charge transport layer not contacting the customer image.

13. The method of claim 1, further comprising:

storing a previously determined thickness of the photoreceptor charge transport layer; and determining the replacement interval based on a comparison of the computed thickness of the photoreceptor charge transport layer to the previously stored thickness of the photoreceptor charge transport layer.

14. A system for predicting a photoreceptor replacement interval, the system comprising:

a first current measuring device that measures charge current supplied to coronode wires and outputs a first current value;

a second current measuring device that measures grid current delivered to at least one of grid wires and a shield and outputs a second current value;

a voltage measuring device that measures voltage of the photoreceptor charge transport layer and outputs a photoreceptor charge transport layer voltage value;

a processor that receives the first current value, the second current value, and the photoreceptor charge transport layer voltage value, and determines a photoreceptor replacement interval based on a thickness of the photoreceptor charge transport layer, wherein the determined thickness of the photoreceptor charge transport layer is based on the first current value, the second current value, and the photoreceptor charge transport layer voltage value;

a storage device for storing the photoreceptor replacement interval; and a display device for displaying the photoreceptor replacement interval.

15. The system of claim 14, further comprising a scorotron charge device including coronode wires, a scorotron shield, and a scorotron grid positioned between the coronode wires and the photoreceptor charge transport layer.

16. The system of claim 15, further comprising:

a pre-charge erase device; and a controller that controls the voltage measuring device, the controller configured to control the voltage measuring device to measure at least one of an initial voltage ($V_{initial}$) of the photoreceptor charge transport layer after a pre-charge erase of the photoreceptor, and an intercept voltage ($V_{intercept}$) of the photoreceptor charge transport layer after rotating the photoreceptor to consecutively charge the photoreceptor charge transport layer by the scorotron charge device with the pre-charge erase device being off, so that charge continues to build through each revolution of the photoreceptor, wherein the processor determines the thickness of the photoreceptor charge transport layer based on the first current value, the second current value, and the at least one of $V_{initial}$ and $V_{intercept}$.

17. The system of claim 15, wherein the controller further controls the first current measuring device and the second current measuring device, and the controller is configured to control the first current measuring device, the second current measuring device, and the voltage measuring device to measure data corresponding to a first data point and a second data point, each data point including a current and a voltage, wherein the processor is configured to receive the first data point measurements and the second data point measurements and calculate a slope (S) of the scorotron charge device between the first data point and the second data point, the processor determining the thickness of the photoreceptor charge transport layer based on the slope (S) and at least one of $V_{initial}$ and $V_{intercept}$.

18. The system of claim 17, wherein the controller is further configured to control the first current measuring device and the second current measuring device to determine a dynamic current ($I_{dynamic}$) delivered to the photoreceptor charge transport layer as the difference between the first current value and the second current value, wherein the processor determines the thickness of the photoreceptor charge transport layer by solving the equations:

$$I_{dynamic\ 1}=Cv(V_{intercept}-V_{initial})(1-e^{-S/Cv})$$

$$C=\in_0 k/d\times 10^6$$

where d=the thickness of the photoreceptor charge transport layer that is to be determined, k=the dielectric constant of the photoreceptor charge transport layer (a known constant), $\in_0$=permittivity of free space (a constant equal to $8.85\times 10^{-12}$), C=capacitance per unit area of the photoreceptor charge transport layer in μf/meter$^2$ (to be determined), and v=velocity of the surface of the photoreceptor charge transport layer in meters/second (a known constant).

19. The system of claim 17, further comprising:

at least one of (1) a pre-charge electrostatic voltmeter positioned between the pre-charge erase device and the scorotron charge device and (2) a pre-development electrostatic voltmeter positioned between an exposure device and a development device, the at least on of the pre-charge and pre-development electrostatic voltmeters comprising the voltage measuring device.

20. A xerographic image forming device including the system of claim 14.

* * * * *